US009392870B2

(12) United States Patent
Suman

(10) Patent No.: US 9,392,870 B2
(45) Date of Patent: Jul. 19, 2016

(54) ADJUSTABLE LAPTOP SUPPORT FOR ELECTRONIC DEVICES

(71) Applicant: Michael J. Suman, Caledonia, MI (US)

(72) Inventor: Michael J. Suman, Caledonia, MI (US)

( * ) Notice: Subject to any disclaimer, the term of this patent is extended or adjusted under 35 U.S.C. 154(b) by 0 days.

(21) Appl. No.: 14/794,296

(22) Filed: Jul. 8, 2015

(65) Prior Publication Data

US 2016/0007734 A1 Jan. 14, 2016

Related U.S. Application Data

(60) Provisional application No. 62/024,085, filed on Jul. 14, 2014, provisional application No. 62/044,552, filed on Sep. 2, 2014.

(51) Int. Cl.

| | |
|---|---|
| ***A47B 3/00*** | (2006.01) |
| ***A47B 23/00*** | (2006.01) |
| ***A47B 23/04*** | (2006.01) |

(52) U.S. Cl.

CPC ..... *A47B 23/002* (2013.01); *A47B 23/043* (2013.01); *A47B 2023/049* (2013.01)

(58) Field of Classification Search

CPC ..... A47B 23/002; A47B 23/001; A47B 9/00; A47B 9/16; A47B 9/18; A47B 23/00; A47B 21/02; A47G 23/0608

USPC ..... 248/27.1, 314, 311.2; 206/217, 822; 108/43, 145, 147

See application file for complete search history.

(56) References Cited

U.S. PATENT DOCUMENTS

| | | | | | |
|---|---|---|---|---|---|
| 70,339 | A | | 10/1867 | Kreitz | |
| 78,250 | A | * | 5/1868 | Withey | A47B 9/16 108/116 |
| 180,052 | A | | 7/1876 | Northrop | |
| 181,732 | A | * | 8/1876 | Shoemaker | A47B 3/0815 108/116 |
| 268,474 | A | * | 12/1882 | Farnham | A47B 9/16 108/116 |
| 544,821 | A | * | 8/1895 | Morrison | A47B 9/16 108/116 |
| 1,571,131 | A | | 1/1926 | McIntosh | |
| 1,670,145 | A | | 5/1928 | Farrington | |
| 1,824,822 | A | * | 9/1931 | Kradolfer | A47B 21/02 108/97 |
| 1,837,826 | A | | 12/1931 | Mitchell et al. | |
| 1,838,856 | A | | 12/1931 | Mitchell et al. | |
| 1,900,250 | A | | 3/1933 | Mitchell et al. | |
| 2,265,105 | A | | 12/1941 | Farrington | |
| 2,476,620 | A | | 7/1949 | Nichols | |
| 2,563,671 | A | | 8/1951 | Basinger | |
| 2,633,248 | A | * | 3/1953 | Goldenberg | A45D 34/00 211/74 |
| 2,640,599 | A | * | 6/1953 | Hess | A47B 96/025 108/102 |
| 2,640,747 | A | | 6/1953 | Bodenhoff | |
| 2,723,037 | A | | 11/1955 | Matesic | |
| 2,956,849 | A | | 10/1960 | Dow | |

(Continued)

*Primary Examiner* — Janet M Wilkens
(74) *Attorney, Agent, or Firm* — Price Heneveld LLP

(57) ABSTRACT

A height-adjustable support apparatus supports items above a user's lap while seated or reclining. The apparatus includes a bottom panel with optional pillow for resting on a seated user's lap, a top panel with upright rests configured to support items (such as electronic devices) at a desired angle of use, a four-bar linkage for moving the top panel between height-adjusted positions while maintaining a same horizontal orientation, and a lock engaging slots in the bottom panel for fixing a selected height-adjusted position of the top panel. Rests on the top panel are made of bent wire and can be selectively pivoted to upright positions for supporting devices, such as a cell phone, tablet computers, books, game displays, etc. A cup holder engages a rest on the top panel to support either a handled container (such as a mug) or no-handle container (such as a soda can).

14 Claims, 10 Drawing Sheets

(56) References Cited

U.S. PATENT DOCUMENTS

| | | | | | |
|---|---|---|---|---|---|
| 3,094,948 | A | | 6/1963 | Clow | |
| 3,134,193 | A | * | 5/1964 | Huffer | A47B 19/08 108/119 |
| 3,147,949 | A | | 9/1964 | Webster | |
| 3,494,306 | A | | 2/1970 | Aguilar | |
| 3,652,051 | A | | 3/1972 | McFarlane | |
| 4,196,674 | A | | 4/1980 | Van Laarhoven | |
| 5,071,002 | A | * | 12/1991 | Bradley | A47G 23/0216 206/217 |
| 5,145,142 | A | | 9/1992 | Szoke | |
| 5,311,210 | A | | 5/1994 | O'Brien et al. | |
| 5,348,263 | A | | 9/1994 | Hubbard | |
| 5,377,946 | A | | 1/1995 | Pannu | |
| D355,786 | S | | 2/1995 | Wolff | |
| 5,398,622 | A | | 3/1995 | Lubinskas et al. | |
| 5,623,869 | A | | 4/1997 | Moss et al. | |
| 6,044,758 | A | | 4/2000 | Drake | |
| 6,173,656 | B1 | | 1/2001 | Blanchard | |
| 6,305,652 | B1 | | 10/2001 | Borke et al. | |
| 6,427,607 | B1 | | 8/2002 | Palmer | |
| 6,957,612 | B2 | | 10/2005 | Conlee | |
| 7,073,449 | B2 | | 7/2006 | Pipkin | |
| 7,293,751 | B2 | | 11/2007 | Eriksson | |
| 7,536,960 | B1 | | 5/2009 | Perez et al. | |
| 7,841,570 | B2 | | 11/2010 | Mileos et al. | |
| 8,215,242 | B2 | | 7/2012 | Aguayo | |
| 8,424,464 | B2 | | 4/2013 | Korpi | |
| 8,671,853 | B2 | * | 3/2014 | Flaherty | A47B 9/18 108/138 |
| 8,985,031 | B2 | * | 3/2015 | Gillotti | A47B 9/16 108/10 |
| 2002/0178972 | A1 | * | 12/2002 | McNeil | A45C 13/00 108/42 |
| 2005/0188899 | A1 | | 9/2005 | Yovich | |
| 2006/0191449 | A1 | * | 8/2006 | Patten | A47B 46/005 108/138 |
| 2007/0113757 | A1 | | 5/2007 | Lilly | |
| 2007/0221811 | A1 | | 9/2007 | Hauser et al. | |
| 2007/0290114 | A1 | | 12/2007 | Tsang et al. | |
| 2008/0011915 | A1 | | 1/2008 | Landman | |
| 2009/0289166 | A1 | | 11/2009 | Hopfer | |
| 2009/0316355 | A1 | | 12/2009 | Jones | |
| 2010/0300334 | A1 | | 12/2010 | Tcholakov | |
| 2011/0017105 | A1 | | 1/2011 | Valdivia | |
| 2011/0219988 | A1 | | 9/2011 | Stephens | |
| 2012/0199622 | A1 | | 8/2012 | Palmer et al. | |
| 2012/0210912 | A1 | | 8/2012 | Florendo | |

* cited by examiner

ADJUSTABLE LAPTOP SUPPORT FOR ELECTRONIC DEVICES

CROSS-REFERENCE TO RELATED APPLICATION

This application claims benefit under 35 USC section 119 (e) of U.S. Provisional Application Ser. No. 62/024,085, filed Jul. 14, 2014, entitled ADJUSTABLE LAPTOP SUPPORT FOR ELECTRONIC DEVICES, and Provisional Application Ser. No. 62/044,552, filed Sep. 2, 2014, entitled ADJUSTABLE LAPTOP SUPPORT FOR ELECTRONIC DEVICES, the entire contents of which are incorporated herein by reference.

BACKGROUND OF THE INVENTION

The present invention relates to adjustable laptop supports useable to support electronic devices and other items on a person's lap while seated or reclining, and more particularly relates to a vertically-adjustable laptop support adapted to rest stably on one's lap to facilitate optimal ergonomic use and positioning of electronic devices as well as providing a strong flat surface that can be used for a variety of work and play activities.

There exist many laptop support devices intended to facilitate use of electronic devices while seated, such as when setting or reclining in a chair, bed, sofa, vehicle, or other seating while talking to others, watching TV, and/or conducting other activities. However, known devices suffer from a variety of limitations. For example, many are not truly adjustable but instead only provide a single use position along with a single collapsed storage position. Other known devices lack durability and/or are otherwise highly susceptible to damage or failure during actual use, such as if a user leans on the product to help stand up while the product is still in an expanded use position. Other known devices are overly expensive and/or too complex for the preference of many users. Also, complexity and excessive number of components drives up manufacturing cost. Other known devices take up too much space when in a storage position, and/or include loose components that fall off or get lost over time. Still further, I have not found an existing laptop support device solving the aforementioned difficulties, nor that holds a top panel in any of several multiple vertically adjustable positions while maintaining a constant flat orientation of the top panel.

Thus, an improved device is desired that provides simplicity of construction, simplicity of adjustment, low cost of manufacture, a non-complex assembly of relatively few parts, safety and durability for long use while promoting ergonomics and comfort.

SUMMARY OF THE INVENTION

In one aspect of the present invention, a height-adjustable support is provided for supporting items above a user's lap while seated or reclining. The support includes a bottom panel adapted to rest on a seated user's lap, a top panel configured to support items above the seated user's lap, and an adjustable support system for holding the top panel at selective horizontal positions above the bottom panel. The present innovation "starts with" a new version of a four-bar linkage system, which includes connecting one or more axles of each four bar pair in a way that guarantees synchronized rotation of top and bottom platforms. By linking the four bar system in this manor it also provides a means of eliminating rotational "chuck" by using the synchronized member as a rotational pivot point which functions as an extended hinge. Doing this also ensures solid support of the top panel above the bottom panel for movement between different height-adjusted positions while maintaining a same horizontal and parallel relationship between the top and bottom members (when the four bar linkage members have a same length). Also, a lock is used to fix a selected position of the top panel. The lock may use gravity or a spring to ensure positive engagement of one (or more) of the bottom panel locking grooves. This design, which is integrally connected to the top panel, permits the linkage to fix one or more of multiple height-adjusted positions. A convenient feature of this locking system may include a simple release lever that provides means of easily disengaging the locking system to allow users an easy and brailable (no look) method of changing height adjustment.

In another aspect of the present invention, a height-adjustable support is provided for use on a user's lap, comprising a bottom member for resting on a seated user's lap, a top panel configured to support items above the seated user's lap, and a height adjustment mechanism supporting the top panel for vertical adjustment while maintaining a desired horizontal orientation.

In still another aspect of the present invention, a method of supporting items above a user's lap while seated or reclining comprises steps of providing an apparatus having a bottom panel adapted to rest on a seated user's lap, a top panel configured to support items above the seated user's lap, and a linkage supporting the top panel above the bottom panel for movement between different height-adjusted positions while maintaining a same horizontal orientation of the top panel. The method includes adjusting the top panel to a desired one of the different height-adjusted positions, and locking the top panel in the desired one position.

An object of the present invention is to provide a height adjustable surface that can be used while sitting on a sofa, recliner, patio chair, office chair, vehicle, bed, or other seating unit (formal or informal).

Another object of the present invention is to provide an apparatus that can be rested on one's lap while its top surface can be adjusted between different horizontal and or parallel positions.

Another object of the present invention is to provide an apparatus that is adjustable to support electronic devices as well as eating, reading, writing, game playing, and other items on a user's lap at a selected height, but that is also adjustable to a collapsed position where it is substantially flat.

Another object of the present invention is to provide an apparatus that is both adjustable and flexible in use to support a variety of different electronic devices, while doing so at optimal ergonomic heights for easy use, but where the apparatus is non-complex, made of relatively few parts, and yet is robust and durable for long use.

Another object of this present invention is to provide an adjustable support system that stores below the top of the upper surface yet articulates above the surface to hold and support a variety of alternative uses. There are two of articulating members that when positioned to a desired location can support items like electronic tablet devices, books, cell phones, artwork, and the like at multiple desired angles.

These and other aspects, objects, and features of the present invention will be understood and appreciated by those skilled in the art upon studying the following specification, claims, and appended drawings.

DETAILED DESCRIPTION OF PREFERRED EMBODIMENT

Figure 1:
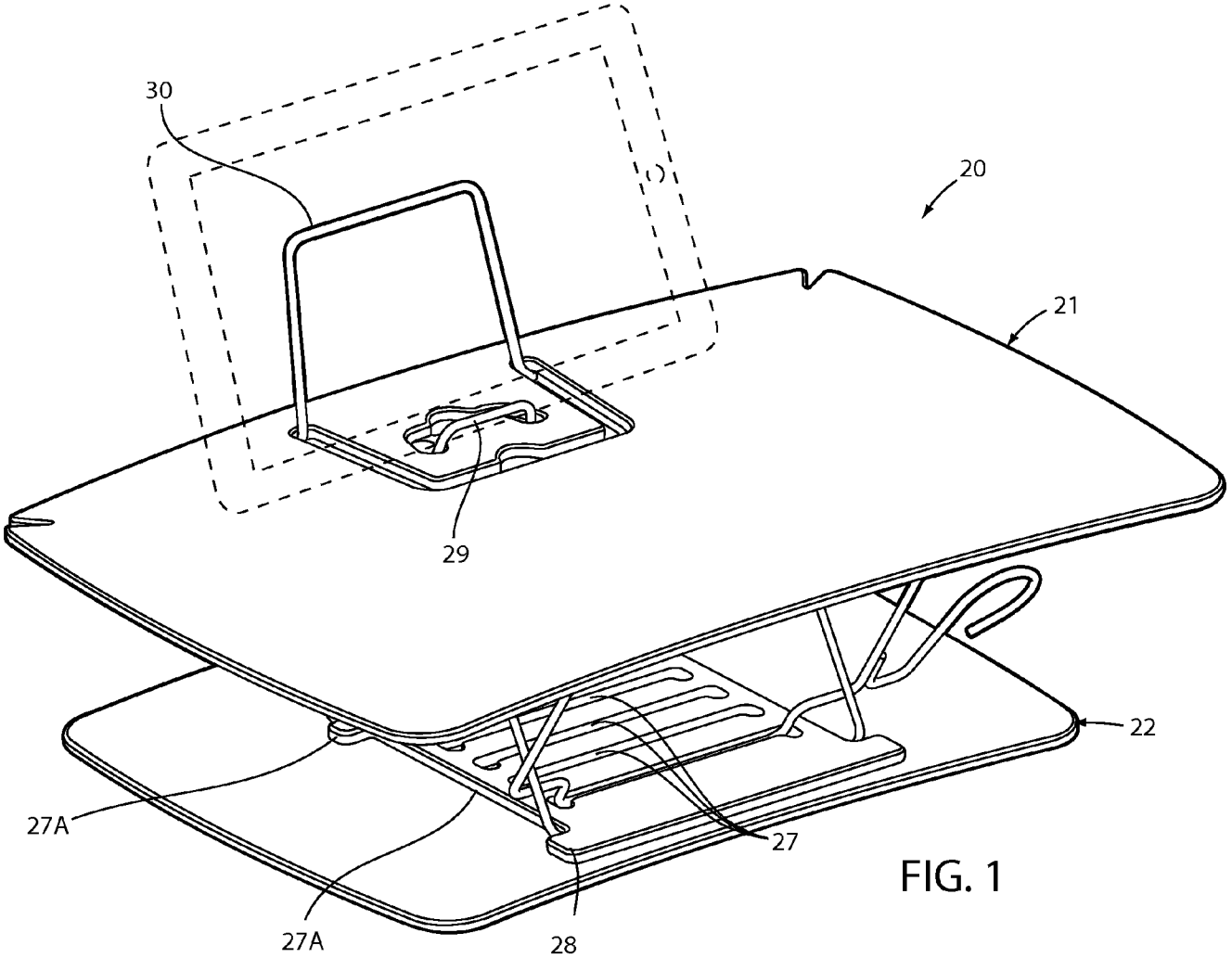
FIG. 1 is a perspective view of the present height-adjustable laptop support apparatus in a fully raised position and with tablet rest supports in a raised use position.
Figure 2:
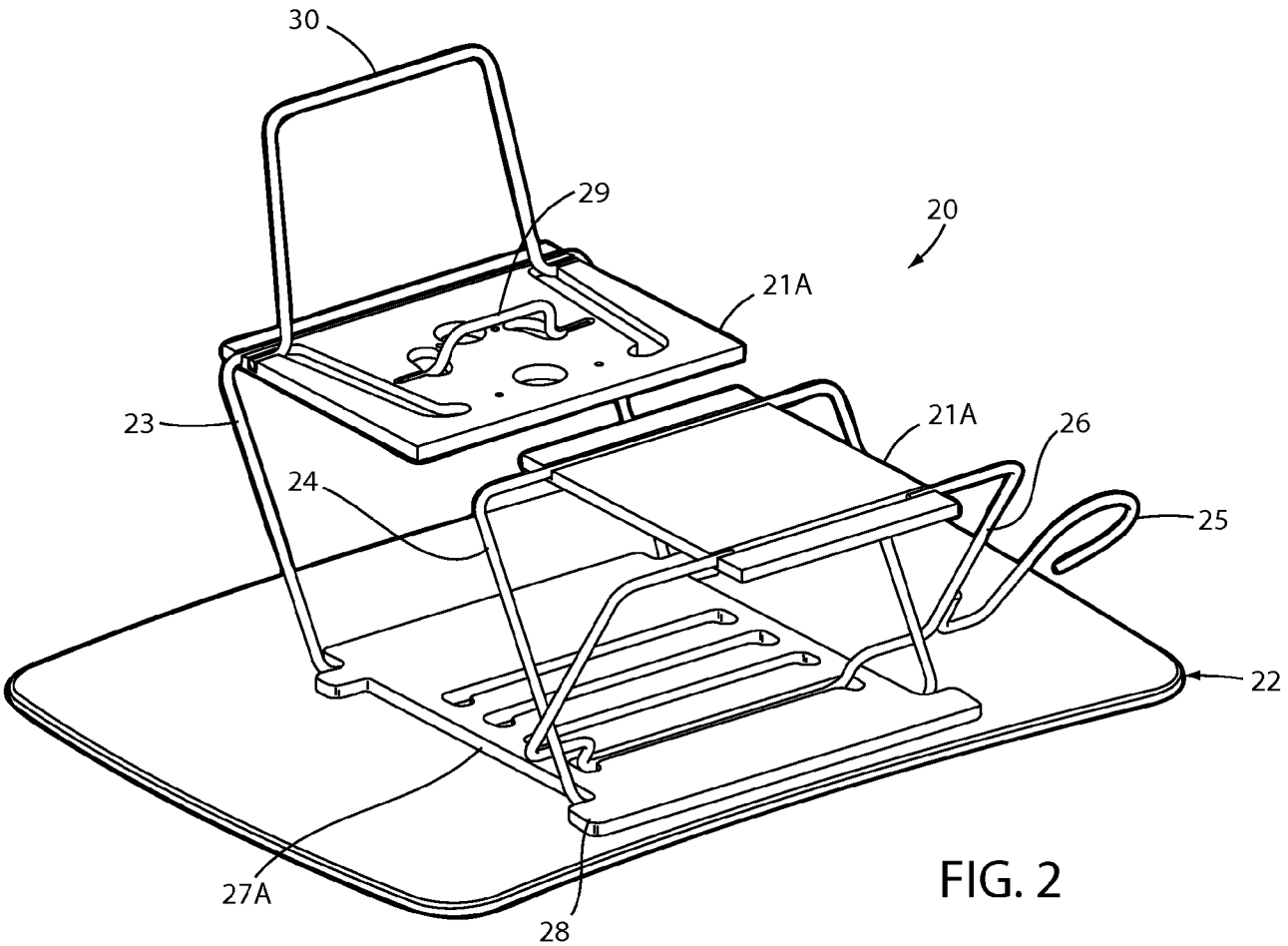
FIG. 2 is a perspective view like FIG. 1, but with a top panel removed to show underlying components.
Figure 3:
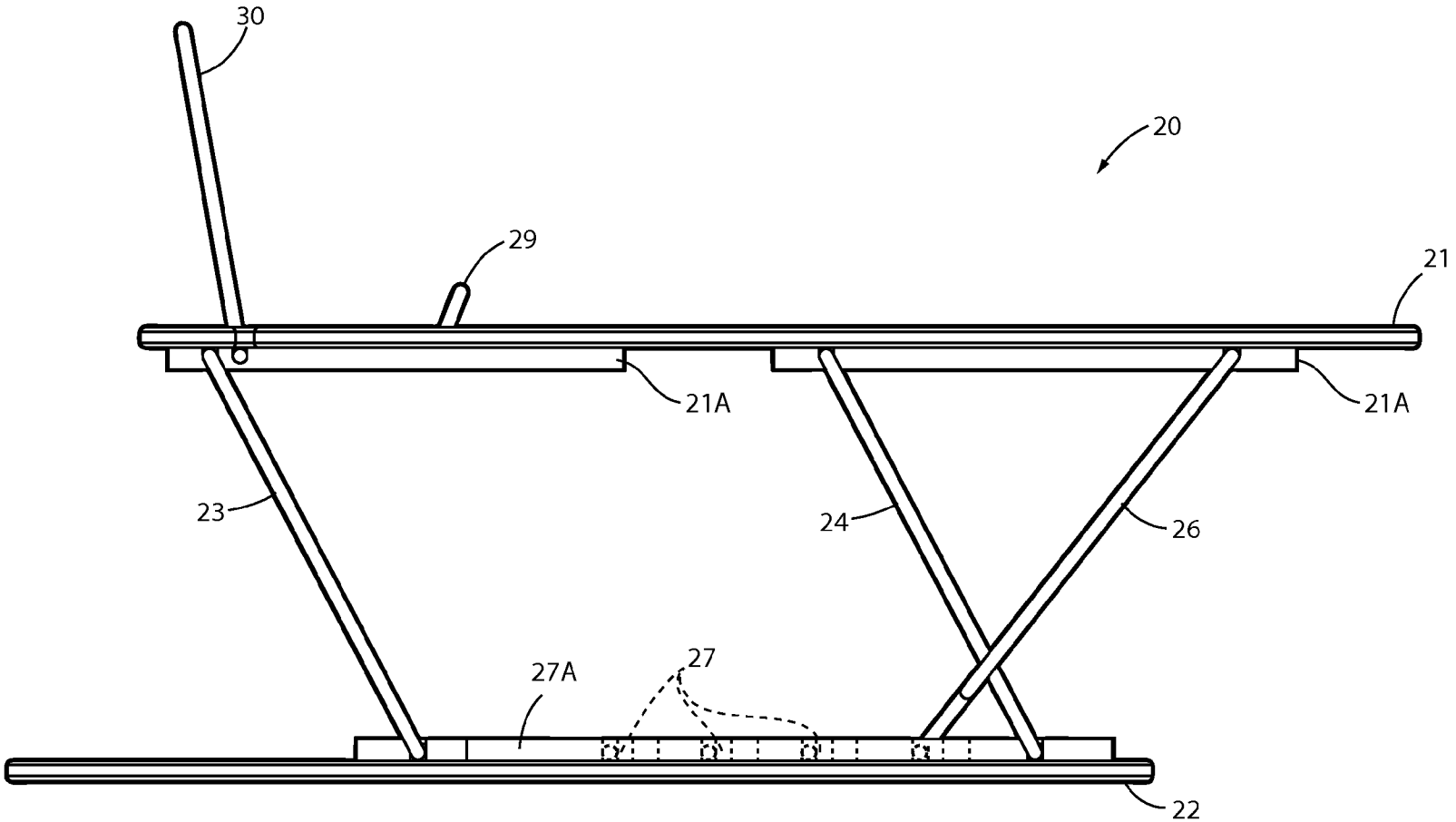
FIGS. 3-5 are side views of FIG. 1, FIG. 3 showing the top panel in a fully raised position, FIG. 4 showing the top panel in a partial height position, and FIG. 5 showing the top panel in a fully closed/storage position.
Figure 4:
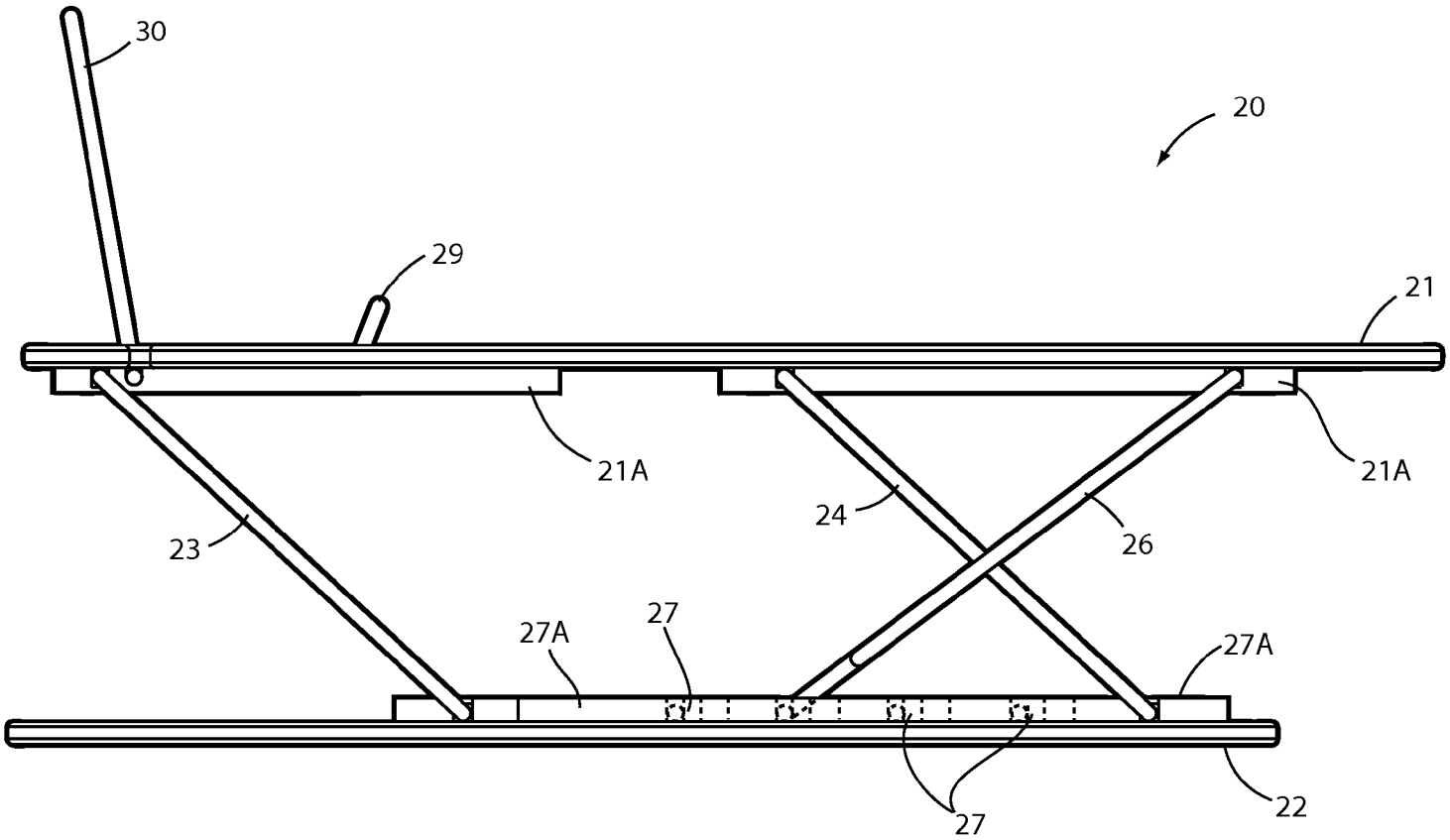
Figure 5:
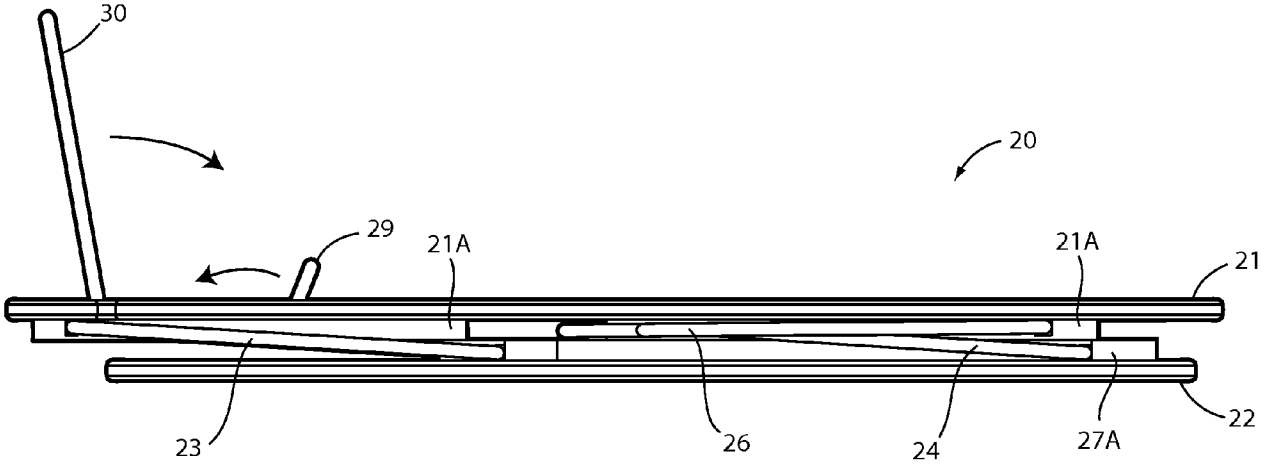

The present adjustable laptop support 20 (also called "apparatus" and "adjustable support surface device") (FIGS. 1-3) includes a top panel 21 (also called "support surface") pivoted to a base panel 22 by connected axle four-bar-linkage (links 23-24) to move the top panel 21 between different vertically-adjusted horizontal positions. The links 23 and 24 are captured by a top pivot-forming member 21A against top panel 21, and captured by a bottom pivot-forming member 27A against the base panel 22, with sections of the wire forming very compact and low-space top and bottom pivots. It is noted that the member 21A can be two separate components as shown, or can be made as a single unitary part. A lock bar 26, with optional loop forming handle 25, selectively engages locking grooves 27 formed by the lower pivot-forming member 27A (hereafter sometimes called "trapping members") for setting a selected height adjustment. The handle 25 is not required per se, but provides a convenient no-look grip for moving the lock bar 26 to a selected height-adjusted position. The illustrated member 27A is shown as a single unitary part, but it is contemplated that it can be made as two separate parts (see component 21A).

Figure 6:
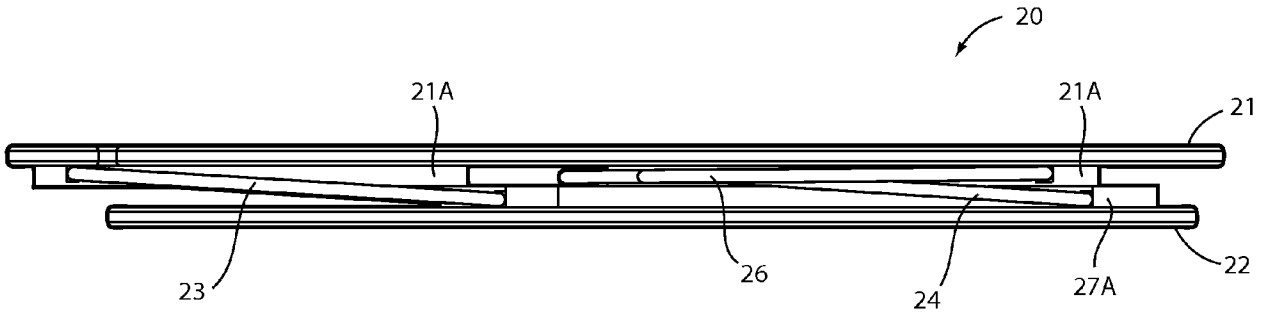
FIG. 6 is a side view like FIG. 5, but with the tablet rest supports in a lowered storage position.
Figure 7:
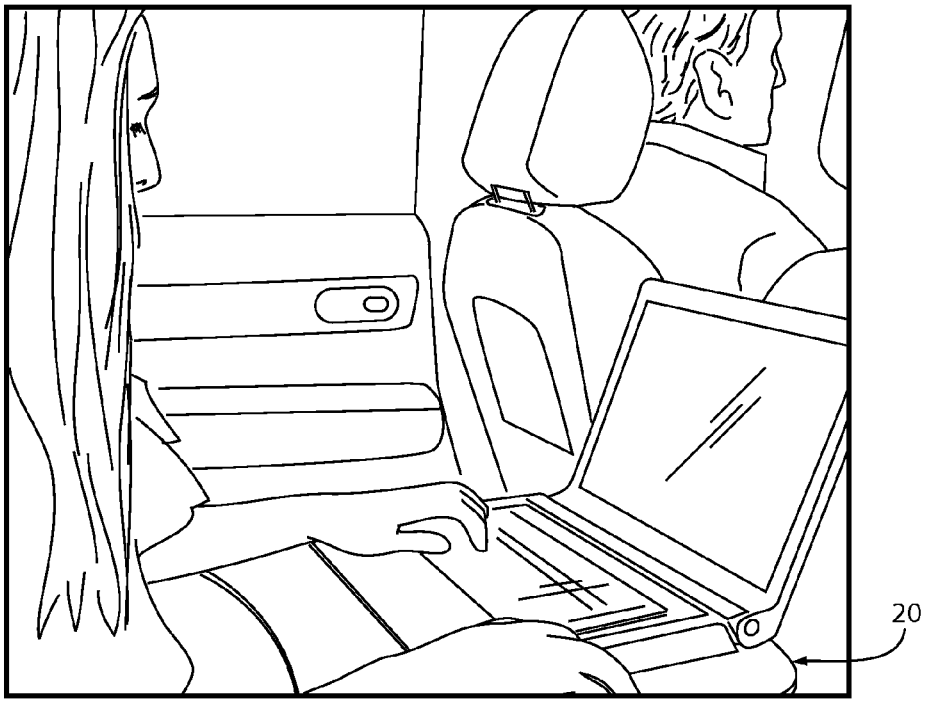
FIGS. 7-10 are perspective views showing the apparatus in FIG. 1 used when seated in a vehicle (FIG. 7), on a couch or recliner (FIG. 8), in a chair or lounger (FIG. 9), and when reclining in a bed (FIG. 10).
Figure 8:
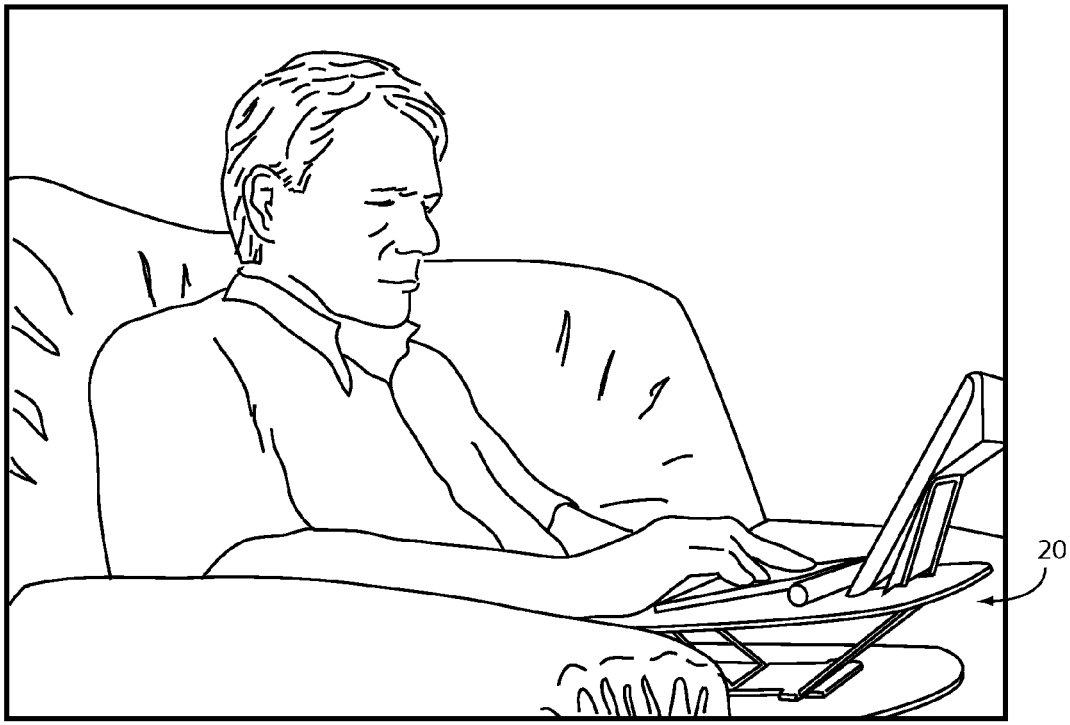
Figure 9:
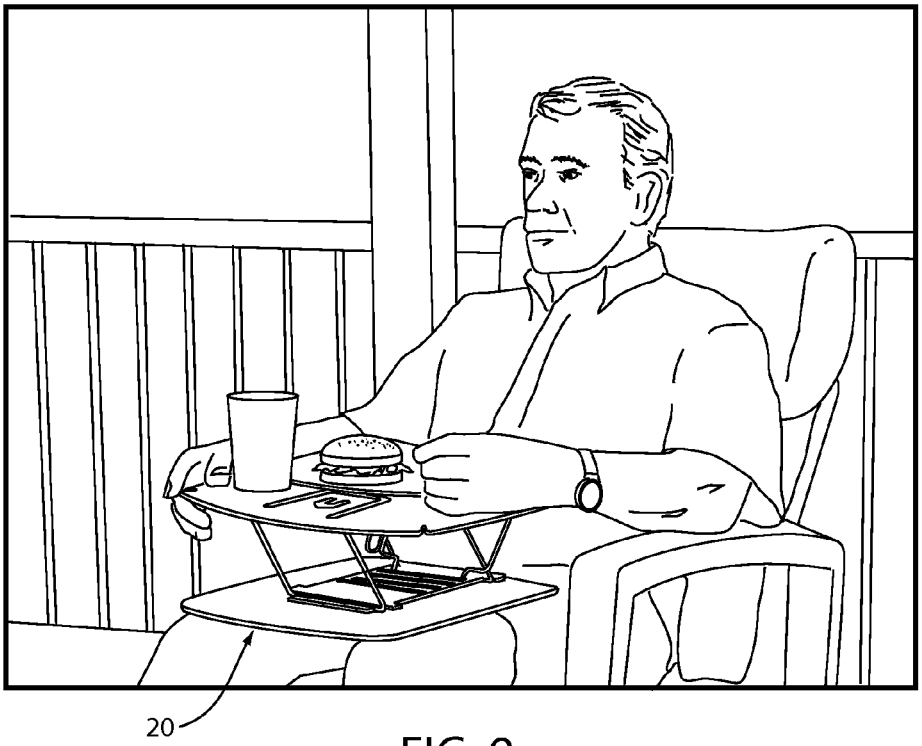
Figure 10:
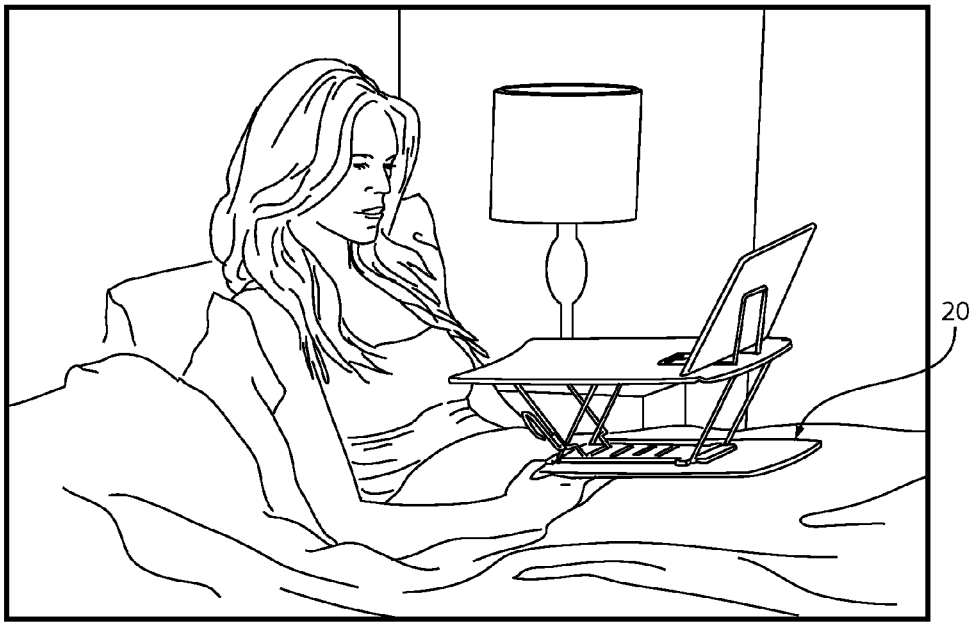

A stop 28 is located on the member 27A to prevent over-travel of the links 23-24. Rests 29-30 formed out of bent metal wire can be pivoted from storage positions in recessed in the top panel 21 (FIG. 6) to upright positions extending above the top panel 21 (FIGS. 1-3) to support a tablet or cell phone at an ergonomic angle on the top panel 21. When moved to a collapsed position, the apparatus 20 closes to a very flat compact arrangement having a combined thickness of the panels 21-22 and the trapping members 21A and 27A.

The support 20 has several advantages including: 1) Folds essentially to a flat "laminar-stacked" condition (where the links 23-24 and lock bar 26 inter-fit to non-interfering flat positions so panels 21-22 and pivot-forming members 21A and 27A combine to be less than 1 inch total thickness); 2) very simple durable parts (with links 23-24 and lock bar 26 and rests 29-30 being bent wire, and with panels 21-22 and grooves 27 and stop 28 being wood, plastic, metal or other structural panel material); 3) very easy release (i.e. lock bar 26 is easy to operate yet provides very sure and positive retention in any of its multiple adjusted use positions and one collapsed storage position with this device being designed such that more weight loaded on the top panel 21 will add to the positive retention forces); 4) no loose parts that can be lost or that will fall out of a storage position (i.e. the top panel 21 includes groves to receive rests 29-30, and also magnets can be put inside grooves to hold rests 29-30 from flopping out of storage grooves); 5) the apparatus is simple yet structurally robust and durable, (i.e. it supports a lot of weight, such as several hundred pounds, even when in an open use position); 6) the structure is simple, while using few parts (e.g. its pivots are formed by simple lateral holes into wood panels 21-22, and wire links 23-24 are assembled by resiliently being bent to slip into the pivot holes and then released). It is noted that a pillow accessory (e.g. an elongated bed pillow or rectangular or square couch pillow) can be provided that attaches to bottom of base panel 22 by Velcro (or other means), with the pillow adding additional comfort, appearance and extra height.

The present apparatus 20 collapses to less than 1" total thickness and extends to multiple raised positions, including an extended height of as much as 6". The top panel 21 is cut with slots and grooves for aesthetics and air circulation to assist in dispersing heat generating by electronic devices, has a perimeter that is aesthetic and avoids sharp corners, and includes holes and other features for providing specific functions such for supporting the links 23,24, the lock bar 26, the rests 29, 30. The illustrated panels 21-22 are birch plywood, but could be alternative materials such as MDF or plastic sheet. The steel wire for links 23-24 and lock bar 26 are bare 3/16" steel, but could be other metal and/or coated (e.g. powder coated). Notably, a coating protects the panels 21-22 and other components from scratching, and helps the components to not accidentally slide out or unexpectedly release. The link 29 or lock bar 26 could be spring biased if desired. Alternatively (or in addition), the links 23-24 and/or lock bar 26 can friction fit into their respective grooves. Finishes for this apparatus can be any type desired, including stained, natural, black, and others.

A significant advantage of the present design is that, by using wire (links 23,24, lock bar 26) to form the hinges/pivot points as shown in the drawings, the overall thickness is reduced to just over one inch when apparatus 20 is fully closed/collapsed. This is because the wire pivot rests against the inside of the top and bottom panels 21, 22, and the wires can be made sufficiently strong even though each has a small diameter. Also, the wires 23, 24, 26 can be formed to non-interferingly overlappingly interfit when in the fully closed position. For example, my testing shows that in apparatus 20, the wire for links 23,24 and lock bar 26 can be less than 0.25 inch diameter and still meet desired functionality and strength requirements. Contrastingly, testing of my early prototypes showed that if pivots were made for the four bar linkage by extending a linear axle through each end of wood links and into pivot-forming members on the panels 21 or 22, each such pivot would take up a lot more space . . . causing the total thickness of the resulting apparatus to be considerably thicker, such as at least 2.5 inches thickness when collapsed, or in other words about 2-3 times a thickness of the present apparatus 20 when fully collapsed.

The prototype of apparatus 20 tested to a failure of well over 100 pounds (specifically, several hundred pounds). Normal loading will be about 10 pounds, but there may be conditions where a higher load will be placed on the apparatus 20, such as when a person is pressing on it to help themselves stand up. The present hinge design provides zero rotational chuck, in part because a relatively long section of the lock bar's wire (26) engages a long section of the mating groove 27, and also due to the fact that additional weight on the hinge and lock bar causes them to engage with increasing strength. Another contributor to this units solid feel and little or no rotational chuck is the connection of the four bar links with one or more connected axles. Using these axles as a continually trapped elongated hinging function contributes greatly to the premium feel and function of this device. It is noted that the groove 27 and mating lock bar wire can be made to have mating cross sectional shapes (i.e. both round), or to provide a level of friction upon engagement. The links 23-24 and lock bar 26 are pyramid shaped to provide a naturally more stable and robust panel-supporting system. Thus, more weight on the lock bar 26, for example, causes the ends of the lock bar's wire to engage more tightly in a lateral direction into their pivot holes in the bottom panel 22.

Additional aspects and features of apparatus 20 include the fact that the present bottom panel is narrower than the top panel. This allows a user to raise the top panel above the armrests on their chair while keeping the smaller part below and between the armrests of the chair. So if someone is setting in an office chair with armrests the smaller portion would be on your lap and the larger top would be above the arms. Still further, the large top panel allows a user to continue using their mouse. (Most known devices do not have a large enough top to be able to comfortably use a mouse.) Notably, even though the present lower panel is smaller than the top panel, the lower panel is shaped so that it doesn't uncomfortably hit a user's knees. At the same time, the lower panel can be as large as the top panel if a customer so desires.

All of the present parts are relatively simple and easy to manufacture with low cost tooling, yet the components are designed to function with a coordinated action that distributes stress effectively for long product life. It is noted that a thickness of the present panels 21-22 and a diameter of the links 23-24 and lock bar 26 are related, and depend very much on the functional requirements of a particular design. The illustrated panels 21-22 are about 0.25 inches (or more) and the trapping members 27A are about 0.25 inches (or more). The rests 29-30 are pivoted to the top panel 21 at ends of the wire of the rests 29-30, and pivot between a stored position inside a matching groove in the top panel 21 and an upright position above the top panel 21 (at a slight rearward angle to provide a good viewing angle for electronic equipment supported on the top panel 21). A magnet can be placed in the matching groove to prevent the rests 29-30 from accidentally pivoting out of their storage position if desired.

Figure 11:
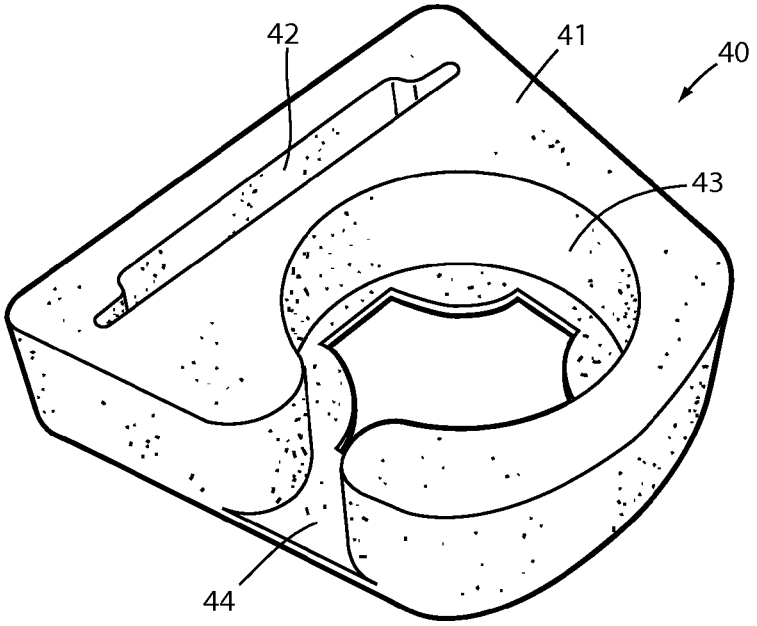
FIGS. 11-12 are perspective views showing opposing sides of a cup holder configured for positive attachment atop the present apparatus.
Figure 12:
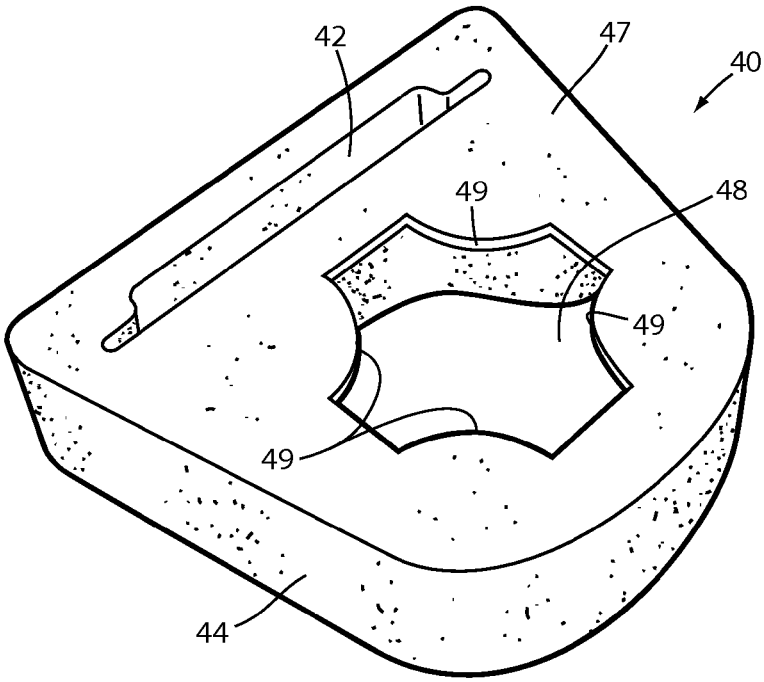
Figure 13:
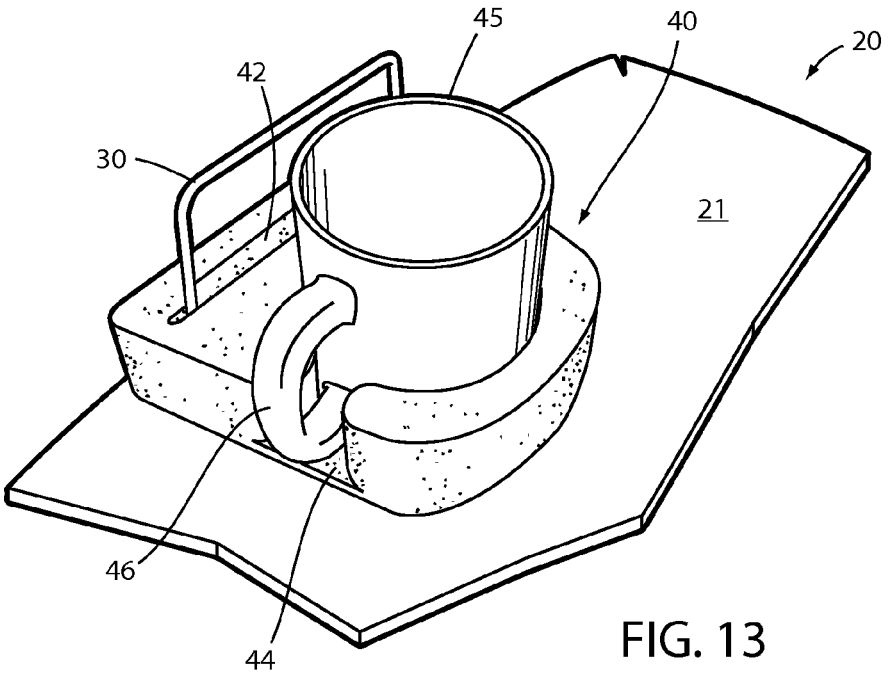
FIGS. 13-14 are perspective views showing the cup holder of FIGS. 11-12 attached atop the top panel of FIG. 1, FIG. 13 showing a cup holder orientation like FIG. 11 for holding a coffee mug with handle, and FIG. 14 showing a cup holder orientation like FIG. 12 for holding a glass or soda can (with no handle).
Figure 14:
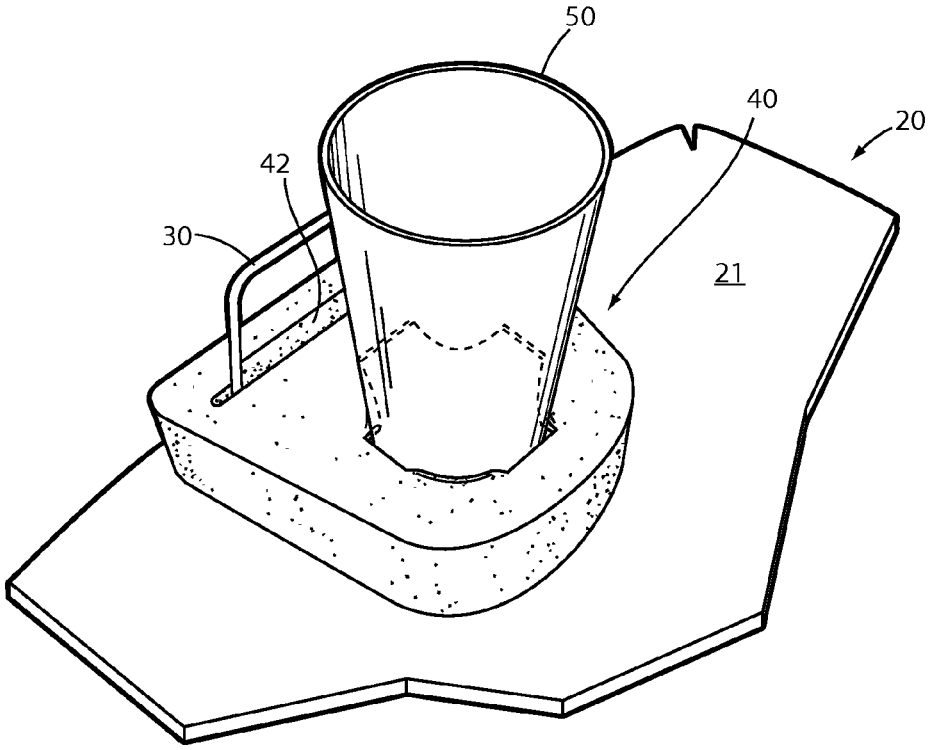

A cup holder 40 (FIGS. 13-14) made of foam or other structural material (that is preferably light-weight moisture-resistant insulating) configured for securement on the top panel 21. Specifically, the cup holder 40 includes a body 41 with a slot 42 for receiving the wire rest 30 (or for receiving the wire rest 29) to stably hold the cup holder 40 on the top panel 21, and further includes a recess 43 with opening 44 on one side for receiving a mug 45 with side handle 46 (FIG. 13). The cup holder 40 includes a resilient sheet 47 (FIG. 12, such as foam or other flexible sheet material) attached to one side of the body 41. The resilient sheet 47 has an opening 48 smaller than the recess 43, or has fingers 49 that extend into the opening 48 for resiliently engaging a glass (or soda can) 50 (FIG. 14). Thus, the cup holder 40 can be placed in one orientation (like FIG. 11) where it can hold a coffee mug 45 with handle 46, or it can be flipped and placed in a different orientation (like FIG. 12) to hold a glass or soda can 50 (with no handle).

Figure 15:
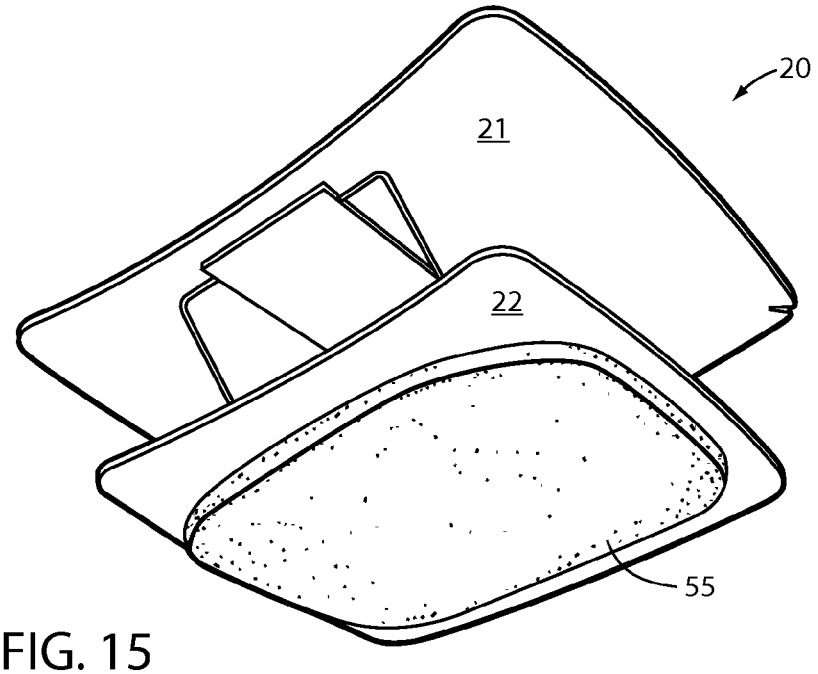
FIGS. 15-16 are assembled and exploded bottom perspective views of the apparatus of FIG. 1, FIG. 15 showing a pillow attached to the bottom panel by patches of hook-and-loop material, and FIG. 16 showing the pillow pulled partially away to reveal the patches of hook-and-loop material on the bottom panel.
Figure 16:
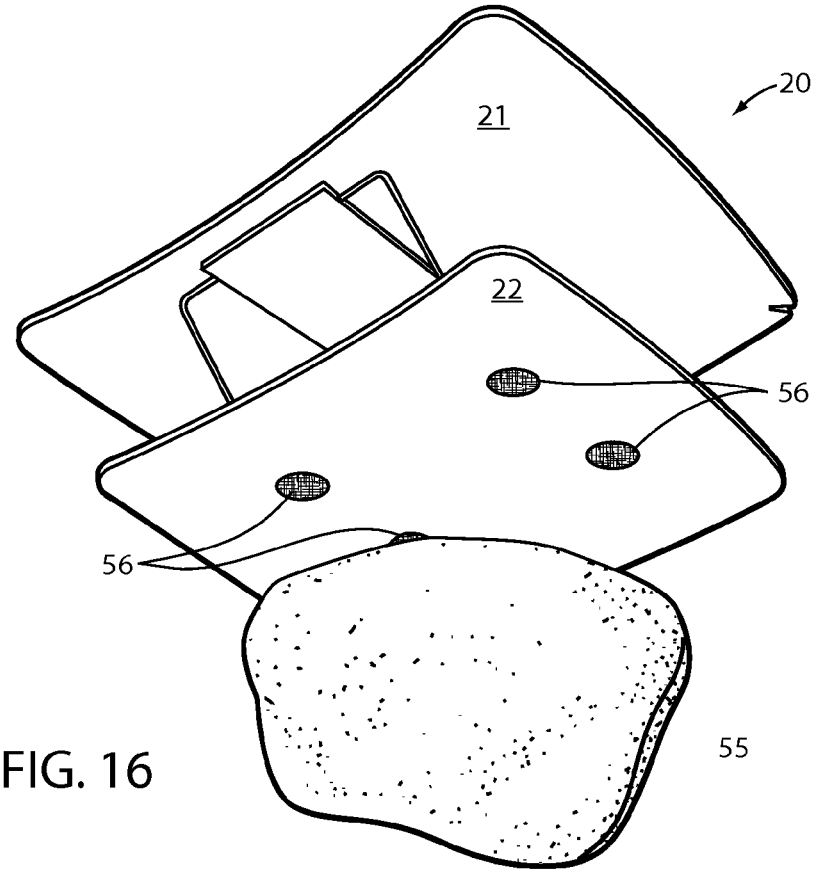

The apparatus 20 can include a pillow 55 (FIGS. 15-16) or other cushioning member under the bottom panel 22 for increased comfort and ergonomic use of apparatus 20. The apparatus 20 in FIGS. 15-16 includes patches 56 of hook-and-loop material on a bottom of the bottom panel 22. The illustrated pillow 55 is made of a knit fabric material that naturally releasably attaches to the patches 56. This eliminates the need for second/additional patch(es) on the pillow 55. But of course, it is contemplated that second patches of hook-and-loop material can be used if desired. It is contemplated that a variety of different cushioning members can be used on a bottom of the bottom panel 22, including pillows with various foam, beads, feathers, or other resilient filler material therein. The illustrated pillow 55 has internal foam pellets move and adjust to a user's legs. Also, the user can selectively move the internal pellets to accommodate a user's position, such as if the user is leaning to one side, or has crossed their legs, or is resting the apparatus 20 on an uneven surface. It is also contemplated that the pillow can be attached using various means, such as easy-to-release mechanical fasteners, releasable adhesive, and other known ways of releasable attachment.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A height-adjustable support for supporting items above a user's lap while seated or reclining, comprising:

a bottom panel adapted to rest on a seated user's lap;

a top panel with at least one upward-facing rest configured to support electronic devices for use above the seated user's lap;

a four-bar linkage with one or more connected axles supporting the top panel above the bottom panel for movement between different height-adjusted positions while maintaining a desired horizontal orientation of the top panel; and a lock engaging one or more of the bottom panel, the top panel, and the linkage for fixing a selected one of the height-adjusted positions;

wherein the four-bar linkage includes U-shaped bent-wire links, each having a pair of parallel legs forming portions of the four-bar linkage.

2. The height-adjustable support of claim 1, wherein the links are pivoted to the bottom panel.

3. The height-adjustable support of claim 1, wherein the bottom panel includes a plurality of grooves, and wherein the lock includes a bent-wire member configured to selectively engage a selected one of the grooves.

4. The height-adjustable support of claim 1, wherein the lock includes a lock bar that engages grooves in one of top and bottom panels, and is pivoted to other one.

5. The height-adjustable support of claim 4, wherein, when in the collapsed position, the four-bar linkage and the lock bar overlap such that a total thickness of the support is substantially a combination of thicknesses of the top panel, the bottom panel, and links in the four-bar linkage.

6. The height-adjustable support of claim 1, wherein the at least one upward-facing rest includes a U-shaped bent wire component.

7. The height-adjustable support of claim 1, wherein the at least one upward-facing rest includes two U-shaped bent wire components of different sizes, each pivoted to the top panel.

8. The height-adjustable support of claim 1, including a pillow releasably attached to a bottom of the bottom panel.

9. The height-adjustable support of claim 1, including an upwardly-facing rest on the top panel, and including a cup holder configured to stably engage the upwardly-facing rest on the top panel to stably support a beverage container on the top panel.

10. The height-adjustable support of claim 9, wherein the cup holder includes a first surface configured to receive a handle-containing container, and includes a second surface configured to receive a handle-absent container.

11. The height-adjustable support of claim 9, wherein the cup holder has a slot shaped to stably engage the upward-facing rest to secure the cup holder on the top panel.

12. A height-adjustable support for a user's lap, comprising:

a bottom panel for resting on a seated user's lap;

a top panel configured to support items above the seated user's lap; and a four-bar linkage supporting the top panel for vertical adjustment while maintaining a desired horizontal orientation to the bottom panel;

the four-bar linkage including U-shaped links that include a single pivot-forming first section pivotally engaging one of the top and bottom panels and extending at least partially across a width of the one panel, panel-to-panel extending second sections that extend from ends of the first section and that extend between the top and bottom panels, and pivot-forming third sections pivotally engaging another one of the top and bottom panels and that extend from the second sections.

13. A height-adjustable support for a user's lap, comprising:

a bottom panel for resting on a seated user's lap;

a top panel configured to support items above the seated user's lap; and a four-bar linkage supporting the top panel for vertical adjustment while maintaining a desired horizontal orientation to the bottom panel;

a pivot-forming top panel member attached to a bottom of the top panel;

a pivot-forming bottom panel member attached to a top of the bottom panel;

the four-bar linkage including links that each include a pivot-forming first section pivotally engaging the pivot-forming top member and that extend at least partially across a width of the top member, panel-to-panel extending second sections that extend from ends of the first section and that rotate with the first section and that extend between the top and bottom panels, and pivot-forming third sections that pivotally engaging the pivot-forming bottom member and that extend from the second sections.

14. A height-adjustable support for a user's lap, comprising:

a bottom panel for resting on a seated user's lap;

a top panel configured to support items above the seated user's lap; and a four-bar linkage supporting the top panel for vertical adjustment while maintaining a desired horizontal orientation to the bottom panel; and an upwardly-facing rest on the top panel that includes two U-shaped wire components pivoted to the top panel, the wire components being closely spaced and configured to overlap when moved to a storage position where the wire components nest into mating grooves in the top panel, but when moved to a raised position, the wire components being configured to engage front and rear opposing surfaces of a handheld electronic device to hold the electronic device in an upright viewable position.

* * * * *